US006966279B2

(12) United States Patent
Sidor

(10) Patent No.: US 6,966,279 B2
(45) Date of Patent: Nov. 22, 2005

(54) PISTON COOLING SYSTEM FOR AN INTERNAL COMBUSTION ENGINE

(75) Inventor: Wayne R. Sidor, Northlake, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/682,510

(22) Filed: Oct. 9, 2003

(65) Prior Publication Data

US 2005/0076859 A1 Apr. 14, 2005

(51) Int. Cl.[7] ..... F01P 1/04
(52) U.S. Cl. ..... 123/41.38
(58) Field of Search ..... 123/41.34, 41.35, 123/41.36, 41.37, 41.38, 41.39, 197.3, 197.4; 74/587

(56) References Cited

U.S. PATENT DOCUMENTS 2,142,175 A * 1/1939 Buttner ..... 123/41.38
2,193,684 A * 3/1940 Hans et al. ..... 123/41.38
2,199,699 A * 5/1940 Frelin ..... 184/6.5
2,534,573 A * 12/1950 Chatterton ..... 123/41.38
3,785,459 A * 1/1974 Patchen ..... 184/6.5
4,231,623 A * 11/1980 Kaufman ..... 384/429
4,342,291 A * 8/1982 Lewis ..... 123/78 B
4,502,423 A * 3/1985 Perry ..... 123/41.38
4,979,427 A * 12/1990 Pfeffer et al. ..... 92/60.5

FOREIGN PATENT DOCUMENTS

JP 06272708 A * 9/1994 ..... F16C 7/02

* cited by examiner

*Primary Examiner*—Henry C. Yuen
*Assistant Examiner*—Hyder Ali
(74) *Attorney, Agent, or Firm*—Dennis Kelly Sullivan; Susan L. Lukasik; Elias P. Soupos

(57) ABSTRACT

A piston cooling system for an internal combustion engine has a connecting rod assembly for connecting a piston to a crankshaft. The connecting rod assembly may have a connecting rod, a connecting rod bearing, a piston pin bushing, and a piston pin. The connecting rod is mounted on the crankshaft with the connecting rod bearing therebetween. The connecting rod is mounted on the piston pin with the piston pin bushing therebetween. The piston pin is connected to the piston. The connecting rod assembly forms a channel. Lubrication fluid flows through the channel and sprays on the piston during engine operation.

20 Claims, 4 Drawing Sheets

PISTON COOLING SYSTEM FOR AN INTERNAL COMBUSTION ENGINE

FIELD OF THE INVENTION

This invention generally relates to internal combustion engines having a system for cooling the pistons. More particularly, this invention relates to diesel engines where oil is sprayed onto the pistons for cooling.

BACKGROUND OF THE INVENTION

Internal combustion engines convert chemical energy from a fuel into mechanical energy. The fuel may be petroleum-based (gasoline or diesel), natural gas, another combustible material, or a combination thereof. Most internal combustion engines mix the fuel with air and then inject the air-fuel mixture into one or more cylinders formed by a crankcase, cylinder head, and piston. The internal combustion engine may use a camshaft system, a hydraulically activated electronically controlled unit injection (HEUI) system, or the like to control the injection of the air-fuel mixture into the cylinders. In each cylinder, the fuel ignites thus generating rapidly expanding gases to actuate the piston. The fuel may be ignited by compression such as in a diesel engine or through some type of spark such as the spark plug in a gasoline engine. The piston usually is connected to a crankshaft or similar device for converting the reciprocating motion of the piston into rotational motion. Thus, an internal combustion engine may be used to propel a vehicle, operate a pump or an electrical generator, or perform other work. The vehicle may be a truck, automobile, boat, or the like.

Some internal combustion engines use an oil spray to lower the temperature of the pistons during engine operation. Each piston has a nozzle is attached inside the engine crankcase at a location between the piston and crankshaft. A tube is attached to the nozzle to provide oil during the engine operation. The tube also is routed through the inside of the crankcase to a pressurized oil supply. The nozzle is aimed or targeted to spray oil against the underside of the piston as the piston actuates in the cylinder.

In many internal combustion engines, it may be difficult to find a location for the nozzle and tube that keeps them away from moving parts such as the piston, connecting rod, and crankshaft. It may be difficult to route the tube through the crankcase to a pressurized oil supply. It also may be difficult to target the oil spray and to maintain the target of the oil spray on the piston.

In addition, the oil spray from the nozzle may provide intermittent cooling of the piston. The nozzle typically is in a stationary position in relation to the piston movement in the cylinder. When the piston is extended into the cylinder (upstroke), the oil spray from the nozzle may not reach the piston. When the piston is retracted from the cylinder (downstroke), the piston may block the oil spray from reaching the desired or target location on the piston.

SUMMARY

This invention provides a piston cooling system for an internal combustion engine. The piston cooling system has a connecting rod assembly with channel. Lubrication fluid flows through the channel and sprays onto the piston.

An internal combustion engine with a piston cooling system may have a crankcase, a piston, a crankshaft, and a connecting rod assembly. The crankcase forms one or more cylinders. A piston is disposed in each cylinder. The crankshaft is disposed in the crankcase. The connecting rod assembly connects the piston to the crankshaft. The connecting rod assembly forms a channel. Lubrication fluid flows through the channel and sprays on the piston during engine operation A piston cooling system for an internal combustion engine may have a connecting rod, a connecting rod bearing, a piston pin bushing, and a piston pin. The connecting rod forms a first conduit and a second conduit. The connecting rod bearing is connected to the connecting rod. The connecting rod bearing forms a bearing groove and a bearing hole. The bearing groove is connected to the bearing hole. The bearing hole aligns with the first conduit. The piston pin bushing is connected to the connecting rod. The piston pin bushing forms a first bushing hole and a second bushing hole. The first bushing hole is aligned with the first conduit. The second bushing hole is aligned with the second conduit. The piston pin is connected to the piston pin bushing. The piston pin forms a piston pin groove connected to the first and second bushing holes.

In a method for cooling a piston in an internal combustion engine, the lubrication fluid is channeled through a connecting rod assembly for a piston. The lubrication fluid is sprayed from the connecting rod assembly onto the piston.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
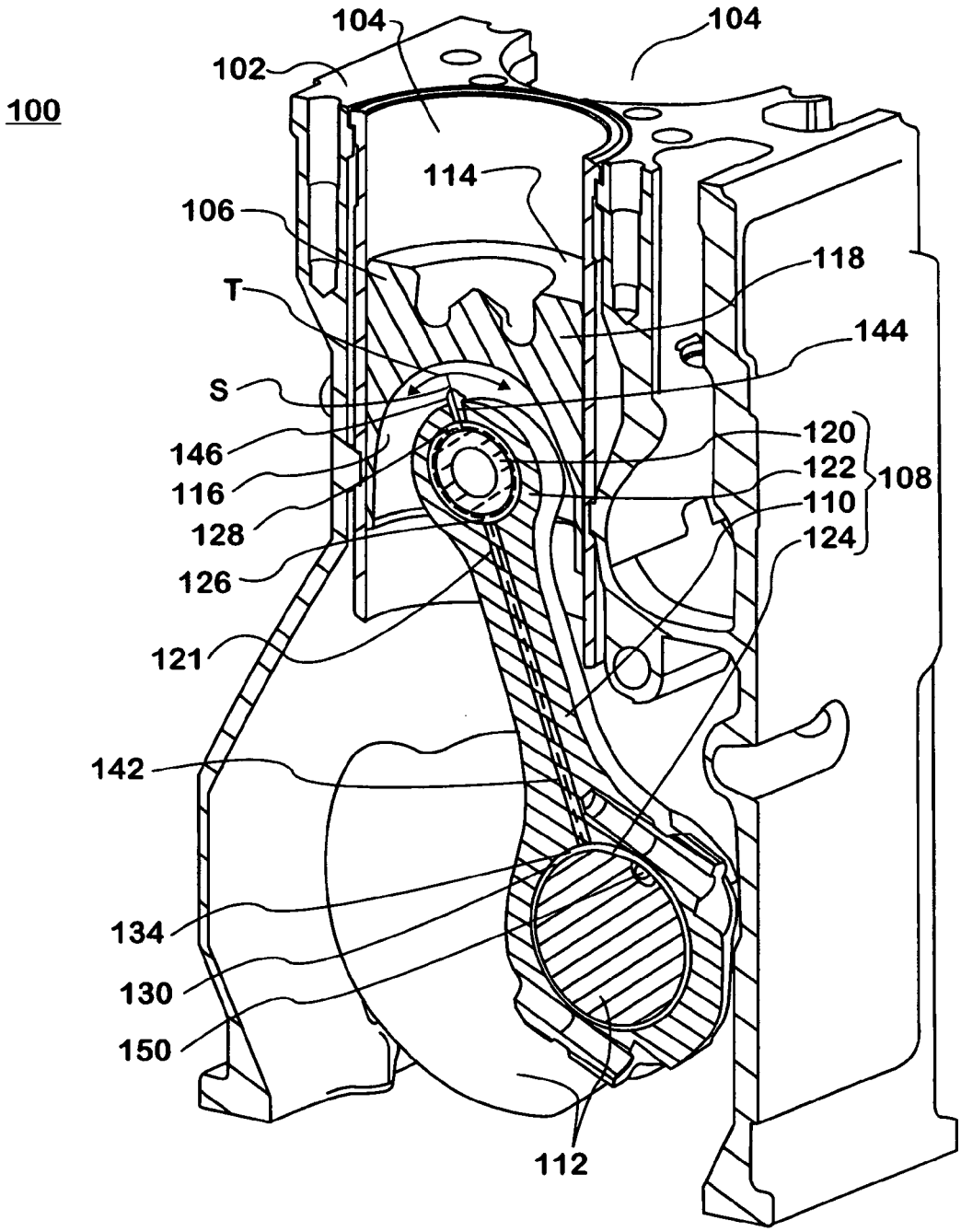
FIG. 1 is a partial cutaway view of an internal combustion engine with a piston cooling system.

FIG. 1 is a partial cutaway view of an internal combustion engine 100 with a piston cooling system. The internal combustion engine 100 may be a gasoline engine, a diesel engine, or the like. The internal combustion engine 100 may be a diesel engine with a hydraulically activated electronically controlled unit injection (HEUI) fuel system. The internal combustion engine 100 has a crankcase 102, which forms one or more cylinders 104. The internal combustion engine 100 may have six, eight, or another number of cylinders 104. Each cylinder 104 has a piston 106 disposed therein. The piston 106 actuates inside the cylinder 104 during operation of the internal combustion engine 100. A connecting rod assembly 108 connects the piston to a crankshaft 112, which is disposed within the crankcase 102. The connecting rod assembly 108 forms a channel or passageway from the crankshaft 112 to the piston 106. During operation, lubrication fluid flows through the channel and is sprayed onto the piston 106. The lubrication fluid may be oil, a synthetic, a combination thereof, and the like. The internal combustion engine 100 may have other components (not shown) such as a cylinder head, a fuel injector and exhaust valves for each cylinder, pumps, an engine cooling system, and the like. While a particular configuration is shown, the internal combustion engine 100 may have other configurations including those with fewer or additional components.

The piston 106 has a head surface 114, an underside surface 116, and a piston skirt 118. The head surface 114 faces the location where fuel is combusted in the cylinder 104. The underside surface 116 is opposite the head surface 114. The piston skirt 118 is disposed between and connects the head surface 114 to the underside surface 116. The piston skirt 118 is disposed adjacent to the surface of the crankcase 102 forming the cylinder 104.

The connecting rod assembly 108 includes a connecting rod 110, a piston pin 120, a piston pin bushing 122, and a connecting rod bearing 124. The connecting rod 110 is attached to the piston pin 120 and the crankshaft 112. The piston pin 120 is connected to the underside surface 116 of the piston 106. The piston pin bushing 122 is disposed between the connecting rod 110 and the piston pin 120. The connecting rod bearing 124 is disposed between the connecting rod 110 and the crankshaft 112. The connecting rod assembly 108 may have a nozzle 146 connected to the connecting rod 110. The nozzle 146 may be a separate component and may be integrated with or formed by the connecting rod 110. The connecting rod assembly 108 may have other components and configurations.

Figure 2:
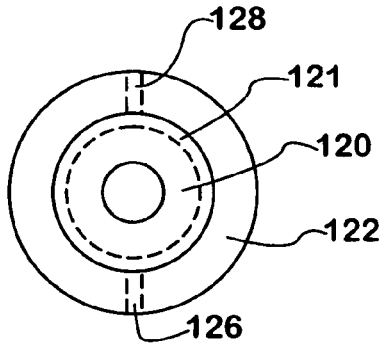
FIG. 2 is a top view of a piston pin bushing mounted on a piston pin.

FIG. 2 is a top view of the piston pin bushing 122 mounted on the piston pin 120. The piston pin bushing 122 forms a first bushing hole 126 and a second bushing hole 128. A hole may be a cavity, chamber, hollow, or other passageway. The first bushing hole 126 may be one hole or a group of holes in the piston pin bushing 122. The second bushing hole 128 may be one hole or a group of multiple holes in the piston pin bushing 122. The first and second bushing holes 126 and 128 may have the same or different configurations. The first and second bushing holes 126 and 128 may extend perpendicularly, angularly, curvilinearly, or a combination thereof. The first and second bushing holes 126 and 128 may have a cross-section with a curvilinear, angular, rectangular, or other shape. The first bushing hole 126 and the second bushing hole 128 may be located opposite of each other or 180° apart. The first bushing hole 126 and the second bushing hole 128 may be at other angles apart.

The piston pin 120 forms a piston pin groove 121 along an outer surface adjacent to the piston pin bushing 122. The piston pin groove 121 connects the first bushing hole 126 with the second bushing hole 128. The piston pin groove 121 may extend across the entire circumference or 360° of the piston pin 120. The piston pin groove 121 may have a path with a circular, elliptical, or have another configuration. The piston pin groove 121 may extend radially across part of the piston pin 120 and tangentially across another part of the piston pin 120. The piston pin groove 121 may have a cross-section with a parabolic, vee, or other shape.

Figure 3:
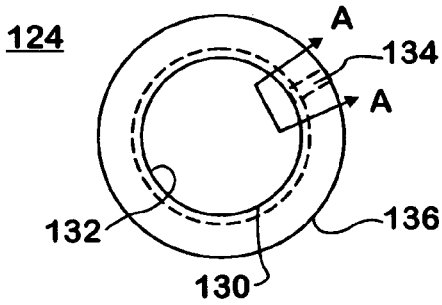
FIG. 3 is a top view of a connecting rod bearing.
Figure 4:
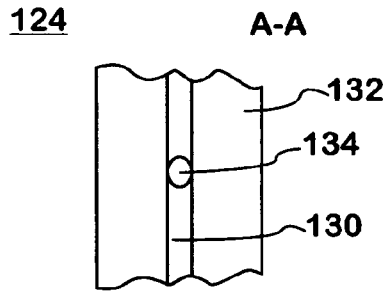
FIG. 4 is an inside radial view of the connecting rod bearing along Section A—A in FIG. 3.

FIG. 3 is a top view of the connecting rod bearing 124. FIG. 4 is an inside radial view of the connecting rod bearing 124 along Section A—A in FIG. 3. The connecting rod bearing 124 forms a bearing groove 130 along an inner surface 132. The bearing groove 130 may extend across the entire circumference or 360° of the inner surface 132. The bearing groove 130 may extend radially across part of the circumference and tangentially across another part of the circumference. The bearing groove 130 may have a path with a circular, elliptical, or other configuration. The bearing groove 130 may have a cross-section with a parabolic, vee, or other shape.

The connecting rod bearing 124 forms a bearing hole 134 extending from the bearing groove 130 to an outer surface 136. The bearing hole 134 may be one hole or a group of holes in the piston connecting rod bearing 124. The bearing hole 134 may extend perpendicularly, angularly, curvilinearly, or a combination thereof. The bearing hole 134 may have a cross-section with a curvilinear, angular, rectangular, or other shape.

Figure 5:
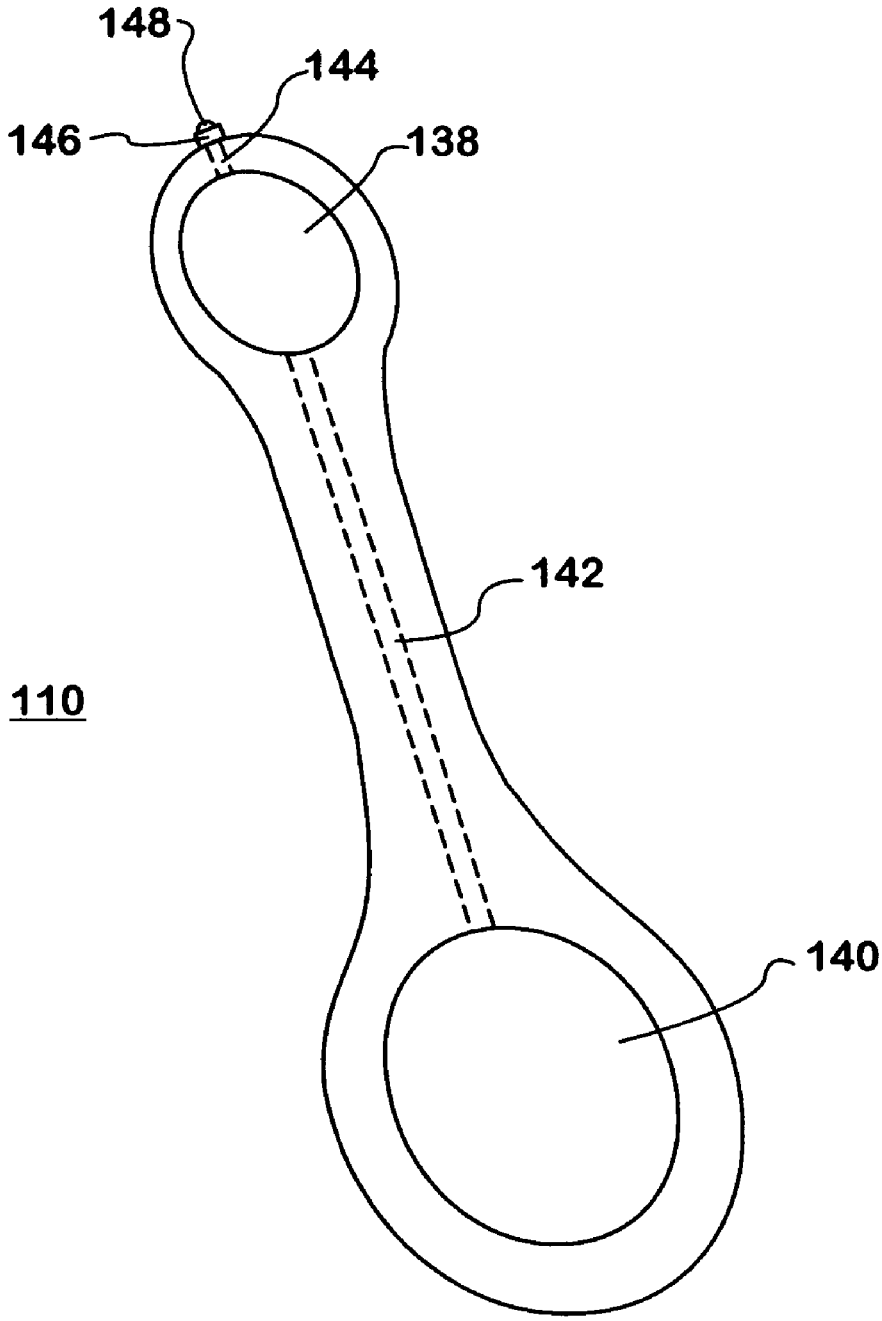
FIG. 5 is a top view of a connecting rod.

FIG. 5 is a top view of the connecting rod 110. The connecting rod 110 has a piston pin opening 138 and a crankshaft opening 140. When the connecting rod assembly 108 is attached to the piston 106, the piston pin opening 138 of the connecting rod 110 fits over the piston pin bushing 122 mounted on the piston pin 120. When the connecting rod assembly 108 is attached to the crankshaft 112, the crankshaft opening 140 of the connecting rod 110 fits over the connecting rod bearing 124 mounted on the crankshaft 112.

The connecting rod 110 forms a first conduit 142 and a second conduit 144. The first conduit 142 extends from the crankshaft opening 140 to the piston pin opening 138. The first conduit 142 may be one hole or a group of holes in the connecting rod 110. The second conduit 144 extends from the piston pin opening 138 to a nozzle 146 attached to the connecting rod 110. The second conduit 144 may be one hole or a group of holes in the connecting rod 110.

The first conduit 142 aligns with the bearing hole 134 when the connecting rod 110 is mounted on the connecting rod bearing 124. "Aligns" includes full and partial alignment. The first conduit 142 and the bearing hole 134 may have the same or different cross-sections. The first conduit 142 also aligns with the first bushing hole 126 when the connecting rod 110 is mounted on the piston pin bushing 122. The first conduit 142 and the first bushing hole 126 may have the same or different cross-sections.

The second conduit 144 aligns with the second bushing hole 128 when the connecting rod 110 is mounted on the piston pin bushing 122. The second conduit 144 and the second bushing hole 128 may have the same or different cross-sections.

The first conduit 142 and the second conduit 144 may have the same or different configurations. The first conduit 142 and the second conduit 144 may have circular, angular, rectangular, or other cross-sections. The first conduit 142 and the second conduit 144 may have the same, different, or variable cross-sections.

The nozzle 146 may be formed by the connecting rod 110 or may be a separate component. The nozzle 146 has an opening 148 that faces the underside surface 116 of the piston 106. The opening 148 may be located on the connecting rod 110 to face any portion of the underside surface 116. The opening 148 may be located on the connecting rod 110 to face a particular portion or target area of the underside surface 116. The nozzle 146 may have multiple openings, which may be arranged in a line, a circle, a dispersion, or other patterns. The opening 148 may have the same or different configuration as the second conduit 144. The opening 148 may have a circular, angular, rectangular, or other configuration.

When assembled, the connecting rod assembly 108 forms a channel or passageway from the crankshaft 112 to the piston 106. The bearing groove 130 on the connecting rod bearing 124 connects with a supply gallery 150 formed on the surface of the crankshaft 112. The supply gallery 150 is a groove or passage for supplying lubrication fluid along the crankshaft 112. The bearing groove 130 may connect to another supply of lubrication fluid. The bearing hole 134 connects with the bearing groove 130 in the connecting rod bearing 124. The first conduit 142 aligns with the bearing hole 134 when the connecting rod 110 is mounted on the connecting rod bearing 124. The first conduit 142 aligns with the first bushing hole 126 when the connecting rod 110 is mounted on the piston pin bushing 120. The first bushing hole 126 is connected to the second bushing hole 128 via the piston pin groove 121 when the piston pin bushing 122 is mounted on the piston pin 120. The second conduit 144 aligns with the second bushing hole 128 when the connecting rod 110 is mounted on the piston pin bushing 120. The second conduit 144 aligns with the nozzle opening 148.

In operation, the lubrication fluid follows the channel from the crankshaft 112 to the nozzle 146. The lubrication fluid flows from the supply gallery 150 through the bearing groove 130 and bearing hole 134 into the first conduit 142. The lubrication fluid flows from the first conduit 142 through the first bushing hole 126, the piston pin groove 121, and the second bushing hole 128 into the second conduit. 144. The lubrication fluid flows from the second conduit 144 into the nozzle 146 and then out of the nozzle opening 148. The lubrication fluid may be pressurized. The lubrication fluid also may lubricate the piston pin 120 and piston pin bushing 122 as the lubrication fluid passes through the first bushing hole 126, the piston pin groove 121, and the second bushing hole 128.

The nozzle opening 148 faces the underside surface 116 of the piston 106. The nozzle 146 sprays the lubrication fluid onto the underside surface 116. The nozzle opening 148 may be disposed for the lubrication fluid to strike one or more particular or target areas on the underside surface 116. The spray, S, may be a dispersion where the lubrication fluid separates into small drops. The spray may be a stream where the lubrication fluid remains together or contiguous. The spray may be a combination of dispersion and stream and may have other configurations and patterns. The nozzle 146 may be disposed for the spray to sweep or move back and forth across a target area, T, on the underside surface 116 during engine operation. The spray may sweep back and forth across different target areas. The spray may sweep the underside surface 116 in other directions and with other patterns.

Figure 6:
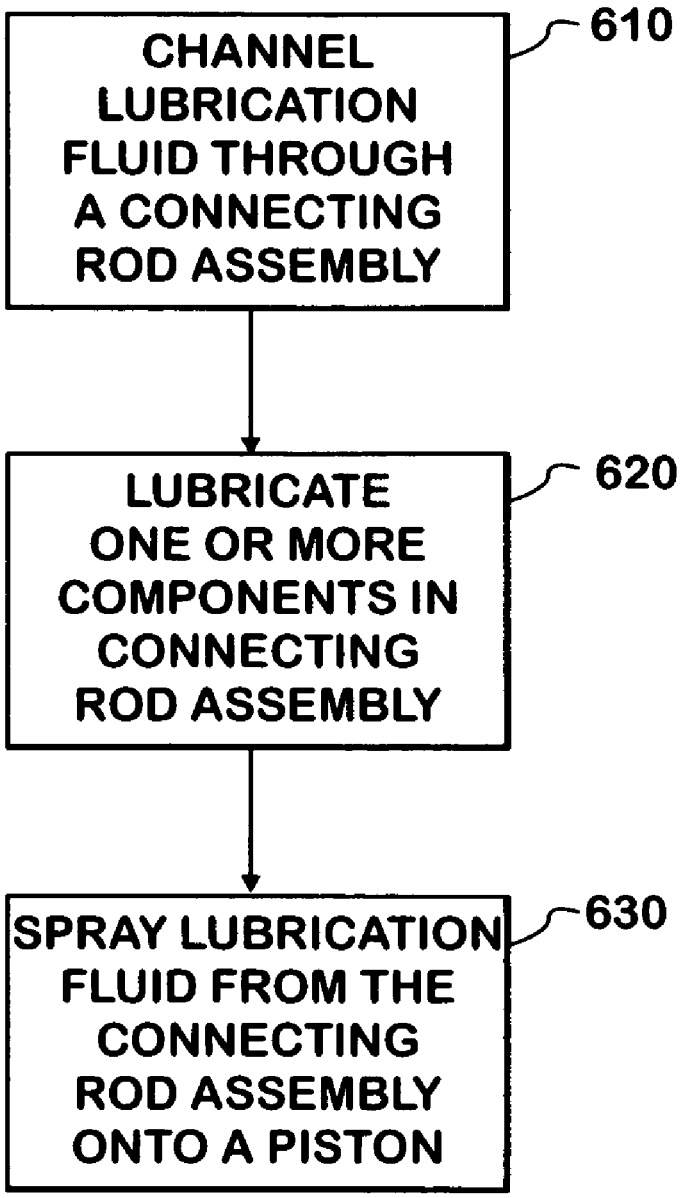
FIG. 6 is a flowchart of a method for cooling a piston in an internal combustion engine.

FIG. 6 is a flowchart of a method for cooling a piston in an internal combustion engine. There may be one or more pistons in the internal combustion engine. The internal combustion engine may use a gasoline, diesel, or another fuel. The internal combustion engine may be a diesel engine with a hydraulically activated electronically controlled unit injection (HEUI) fuel system.

In block 610, lubrication fluid is channeled through a connection rod assembly. The connection rod assembly may have components in a configuration similar to the connection rod assembly previously discussed. The lubrication fluid may be channeled from a supply gallery in a crankshaft through a bearing groove and bearing hole into a first conduit. The lubrication fluid may be channeled from the first conduit through a first bushing hole, a piston pin groove, and a second bushing hole into a second conduit. The lubrication fluid may be channeled from the second conduit into a nozzle and then out of a nozzle opening. The connection rod assembly may have other configurations including those with fewer or additional components.

In block 620, the lubrication fluid lubricates one or more components in the connection rod assembly. The lubrication fluid may lubricate a piston pin and a piston pin bushing as previously discussed. The piston pin and piston pin bushing may be lubricated as the lubrication fluid is channeled through the first bushing hole, the piston pin groove, and the second bushing hole. The lubrication fluid may lubricate other components in the connection rod assembly.

In block 630, the lubrication fluid is sprayed onto the piston in the internal combustion engine. The lubrication fluid may be sprayed onto an underside surface of the piston as previously discussed. The lubrication fluid may be sprayed on one or more target areas on the underside surface. The spray may be a dispersion, a stream, a combination thereof, and may have other configurations and patterns. The spray may sweep back and forth across one or more target areas. The spray may sweep the underside surface in other directions and with other patterns While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. An apparatus comprising:

a connecting rod having a first passage and a second passage;

a first groove disposed along an entire circumference of a bearing surface of the connecting rod, the first groove in constant fluid communication with the first passage;

a second groove disposed along an entire circumference of a pin interface surface of the connecting rod, the second groove in constant fluid communication with the first passage and the second passage;

wherein lubrication fluid flows through the first passage and the second passage and sprays on a piston during engine operation.

2. The apparatus of claim 1, wherein the piston has an underside surface, and wherein the lubrication fluid sprays onto the underside surface.

3. The apparatus of claim 1, wherein the apparatus comprises a connecting rod, a connecting rod bearing, a piston pin, and a piston pin bushing;

wherein the connecting rod bearing is disposed between the connecting rod and the crankshaft;

wherein the piston pin bushing is disposed between the connecting rod and the piston pin.

4. The apparatus of claim 1, wherein the first groove is disposed in a connecting rod bearing.

5. The apparatus of claim 1, wherein the second groove is disposed in a piston pin.

6. The apparatus of claim 5, further comprising a first bushing hole and a second bushing hole disposed in the piston pin bushing, wherein the first bushing hole and the second bushing hole are in fluid communication with the second groove.

7. The apparatus of claim 6, wherein the first bushing hole and the second bushing hole are in fluid communication with the first passage and the second passage.

8. The apparatus of claim 4, wherein apparatus comprises a nozzle in fluid communication with the connecting rod, wherein the nozzle forms a nozzle opening, and wherein the nozzle opening aligns with the second passage.

9. An internal combustion engine comprising the apparatus of claim 1.

10. The apparatus of claim 4, wherein the crankshaft forms a lubricating fluid supply, and wherein the first groove is in fluid communication with the lubricating fluid supply.

11. The apparatus of claim 5, wherein the second groove extends radially across a first part of the piston pin and tangentially across a second part of the piston pin.

12. A piston cooling system for an internal combustion engine comprising:

a connecting rod having a piston pin opening a crankshaft opening, a first passage, and a second passage;

a first groove in constant fluid communication with the first passage and the crankshaft opening;

a second groove in fluid communication with the piston pin opening and the second passage;

wherein the piston pin opening is disposed between the first passage and the second passage;

wherein the first replace is in constant fluid communication with the piston pin opening;

wherein lubrication fluid flows through the first passage and the second passage to spray on a piston during engine operation.

13. The piston cooling system of claim 12, further comprising a piston pin, wherein the second groove is disposed in the piston pin.

14. The piston cooling system of claim 12, wherein the second groove extends circumferentially along substantially entirely a pin interface surface of the piston pin opening.

15. The piston cooling system of claim 12, wherein the first groove extends circumferentially along substantially entirely a bearing surface of the crankshaft opening.

16. The piston cooling system of claim 12, further comprising a nozzle in fluid communication with the connecting rod, wherein the nozzle forms a nozzle opening, and wherein the nozzle opening aligns with the second passage.

17. The piston cooling system of claim 12, wherein the first groove extends across an entire circumference of the bearing surface.

18. The piston cooling system of claim 12, further comprising a connecting rod bearing disposed on the connecting rod, wherein the first groove and a bearing hole are disposed in the connecting rod bearing, and wherein the bearing hole is in fluid communication with the first groove.

19. The piston cooling system of claim 12, further comprising a piston pin bushing disposed on the connecting rod, wherein the second groove is disposed in the piston pin bushing.

20. The piston cooling system of claim 18, further comprising a first bushing hole and a second bushing hole disposed in the piston pin bushing, wherein the first bushing hole and the second bushing hole are in fluid communication with the second groove.

* * * * *